US009926494B1

(12) United States Patent
Whitezell et al.

(10) Patent No.: US 9,926,494 B1
(45) Date of Patent: Mar. 27, 2018

(54) METHOD FOR RECOVERY OF HYDROCARBONS FROM RESOURCES COMPRISING DIATOMITE

(71) Applicant: California Jet Oil, LLC, Bakersfield, CA (US)

(72) Inventors: Marc A. Whitezell, Bakersfield, CA (US); Stanley W. Ellis, Bakersfield, CA (US)

(73) Assignee: CALIFORNIA JET OIL, LLC, Bakersfield, CA (US)

( * ) Notice: Subject to any disclaimer, the term of this patent is extended or adjusted under 35 U.S.C. 154(b) by 0 days.

(21) Appl. No.: 15/225,777

(22) Filed: Aug. 1, 2016

Related U.S. Application Data

(60) Provisional application No. 62/199,837, filed on Jul. 31, 2015.

(51) Int. Cl.

| | |
|---|---|
| ***C10G 1/04*** | (2006.01) |
| ***C10G 1/00*** | (2006.01) |
| ***E21B 43/40*** | (2006.01) |
| ***E21B 21/06*** | (2006.01) |

(52) U.S. Cl.
CPC ..... *C10G 1/045* (2013.01); *C10G 1/002* (2013.01); *E21B 21/066* (2013.01); *E21B 43/40* (2013.01); *C10G 2300/201* (2013.01); *C10G 2300/80* (2013.01)

(58) Field of Classification Search
CPC ..... C10G 1/04
See application file for complete search history.

(56) References Cited

U.S. PATENT DOCUMENTS

| | | | | |
|---|---|---|---|---|
| 4,167,470 | A | 9/1979 | Kamofsky | |
| 4,239,617 | A | 12/1980 | Kamofsky | |
| 4,240,897 | A * | 12/1980 | Clarke | C10C 3/007 208/425 |
| 4,374,023 | A | 2/1983 | Davis | |
| 4,461,695 | A | 7/1984 | Williams | |
| 4,539,093 | A | 9/1985 | Freidman et al. | |
| 4,719,008 | A * | 1/1988 | Sparks | C10G 1/04 208/390 |
| 5,571,403 | A | 11/1996 | Scott et al. | |
| 2015/0107905 | A1 | 4/2015 | Kinley et al. | |

OTHER PUBLICATIONS

M. E. Allan et al., Development of the Belridge Field's Diatomite Reservoirs with Hydraulically Fractured Horizontal Wells: From First Attempts to Current Ultra-Tight Spacing, SPE Annual Conference and Exhibition (SPE 133511) (Florence, Italy 2010).*

* cited by examiner

*Primary Examiner* — Randy Boyer
(74) *Attorney, Agent, or Firm* — James M. Duncan, Esq.; Klein DeNatale Goldner

(57) ABSTRACT

A method for the recovery of hydrocarbons from oil-bearing resources comprising diatomite entails a process that treats a material comprising diatomite resulting from a resource extraction process. The material comprising diatomite is treated using a solvent extraction process from which the oil, diatomite, and water are separated. The water and solvent extracted from the process are reused to continue the separation and resource extraction processes and the oil is collected and sold.

15 Claims, 2 Drawing Sheets

METHOD FOR RECOVERY OF HYDROCARBONS FROM RESOURCES COMPRISING DIATOMITE

RELATED APPLICATIONS

This application claims priority to provisional patent application No. 62/199,837 filed on Jul. 31, 2015

BACKGROUND

The present invention relates to a method of recovering oil from hydrocarbon saturated resources having low permeability and high porosity such as those comprising diatomite. Diatomite, also known as diatomaceous earth, is a sedimentary rock comprising the siliceous skeletal remains of single-celled algae called diatoms. The rock itself is unique, with porosities that can exceed 70% (double that of a comparable sandstone) but with extremely low permeability (as low as 1 md or less) that limit fluid flow through the rock. Some diatomite deposits have been saturated with hydrocarbons, creating unique oil and gas reservoirs holding large quantities of hydrocarbon resources. For example, California's diatomite resources located in the San Joaquin Basin are estimated to contain in excess of 19 billion barrels of original oil in place. As a result, there have been significant efforts to develop techniques to recover oil from this prolific resource over the past 4 decades, with only limited success.

Ex Situ Extraction Methods:

Due to its high porosity, diatomite resources exhibit exceptional fluid storage capacities, containing twice as much oil per unit volume of rock when compared to a traditional sandstone reservoir. Such a concentration of oil makes the rock particularly attractive as a mining target, as the ore value is significantly higher (double) than that of a traditional oil sands mining operation. Diatomite is also relatively soft, allowing easier, lower cost extraction of the material. As a result, there was initially a large interest in evaluating the potential for surface mining shallow diatomite oil resources, thus allowing one to bypass the permeability limitations of in situ oil recovery methods.

Prior mining processes all suffer from one or more of several defects or limitations that prevented them from being adopted as viable diatomite oil recovery methods. In particular, an economic method is required to properly separate the oil and rock derived from the chosen mining process.

Prior oil extraction methods from diatomaceous rock do not address the treatment of the diatomite as a slurry, but assume the rock is relatively dry, being extracted using traditional surface mining techniques. Notwithstanding, prior diatomite oil separation processes using extracting solvents fail to recover a sufficient amount of extracting solvent for reuse in the extracting process. Other processes fail to efficiently recover the extracting solvent. There are also problems associated with the presence of fines, including fines removal from product streams.

Still other processes produce emulsions, which are difficult and relatively expensive to handle. Yet other processes produce waste products which are likewise difficult to handle, while other processes use equipment which must be specially fabricated for use in the particular process. These and other defects or limitations are minimized if not eliminated by the present inventive method.

In Situ Extraction Methods:

As a result of the limitations of mining methods and associated ex situ oil recovery techniques, oil recovery processes were eventually adopted that are derivatives of more conventional in situ oil recovery methods, such as relying on the use of hydraulic fracturing to create flow paths by which the oil may flow from the rock. In cases where the diatomite resources are saturated with heavy oil, as is common in California, steam is injected to simultaneously lower the oil viscosity and fracture the rock. The reliance of current recovery methods on fracturing the formation limits recovery efficiencies since much of the rock is not contacted by the induced fracture systems and is bypassed, leaving the oil trapped within. Beyond having limited effectiveness at recovering oil from diatomite, current in situ processes are highly complex to manage and extremely inefficient.

In practice, steam fracturing recovery methods require large amounts of steam injection and take decades to recover only a small amount of the original oil in place. Environmental impacts are high, and the process efficiency is low. Following is a list of some of the highlighted weaknesses of current in situ recovery approaches:

High Carbon Footprint: As a result of burning fuel to generate steam, steam fracturing operations have some of the highest greenhouse gas emissions for oil recovery projects in the world.

Net Energy Consumption: Applying current in situ recovery methods may often require more energy to extract the oil that the energy content of the oil itself.

Subsidence and Well Failure: As a result of the high porosity and compressibility of diatomite rock, well failure rates can approach 50% per year if injection activities are not properly managed. Even with proper injection management, well failures are a common occurrence.

Surface Events: Eruptions of steam and water at surface are common due to the large injected volumes at shallow depths (sometimes less that 200 feet below the surface). These events have resulted in both environmental and safety threats.

Surface Impacts: Due to the low permeability of the rock, development requires extremely tight well spacing—as tight as ¼ acre spacing. Combined with a high intensity of surface infrastructure to support injection and production activities, a typical diatomite development results in significant long-term alterations to the natural environment.

Production costs are high, limiting the ability of operators to economically recover the resource.

It is apparent that an improved method of producing oil from low permeability high porosity resources such as diatomite is much desired.

SUMMARY OF THE INVENTION

A greatly improved method for the recovery of hydrocarbons from low permeability, high porosity resource deposits such as diatomite is disclosed herein.

A slurry is derived from an extraction method and is dewatered, allowing the water to be reused in the extraction process. The diatomite, comprising only a small amount of water after the dewatering process, is processed to reduce particle size and mixed thoroughly with a solvent. The diatomite/solvent slurry is mixed into a homogenous mixture, allowing the solvent to saturate the diatomite and dissolve into the oil. The mixture is then separated using gravitational and/or centrifugal methods as required, into its constitutive elements of diatomite, solvent/oil mixture, and water. The process of mixing the diatomite with solvent may be repeated as necessary until a desired recovery of hydrocarbons is achieved. Each subsequent cycle should preferably use clean solvent to maximize oil recovery. The water separated by this process is reused to support the mining method.

Upon successful recovery of hydrocarbons from the diatomite, the rock is heated, such as by using thermal desorption, to evaporate and recover any remaining solvent. The recovered solvent is condensed and reused in the process. The cleaned, dried diatomite is then stored until the processing is complete.

The oil is separated from the solvent mixture using a distillation process. The solvent recovered from the distillation process is then reused in the oil recovery process.

The processes steps described above may then be repeated on a field-wide basis until the targeted diatomite resource is completely processed.

The benefits of this process compared to current in situ diatomite oil extraction methods include:

- Clean
- Up to 95% reduction in greenhouse gas emissions
- Process requires no fresh water, can use oilfield produced water
- All water is recycled and reused in the process—no disposal requirements
- Reduced surface disturbance
- Safe
- No hydraulic fracturing
- No high temperature, high pressure steam injection required
- No surface eruptions
- Clean rock is returned safely back underground
- Efficient
- Up to 95% reduction in energy consumption
- More that four times the amount of oil recovered from rock
- Oil extraction time reduced from decades to days

DETAILED DESCRIPTION OF THE INVENTION

Figure 1:
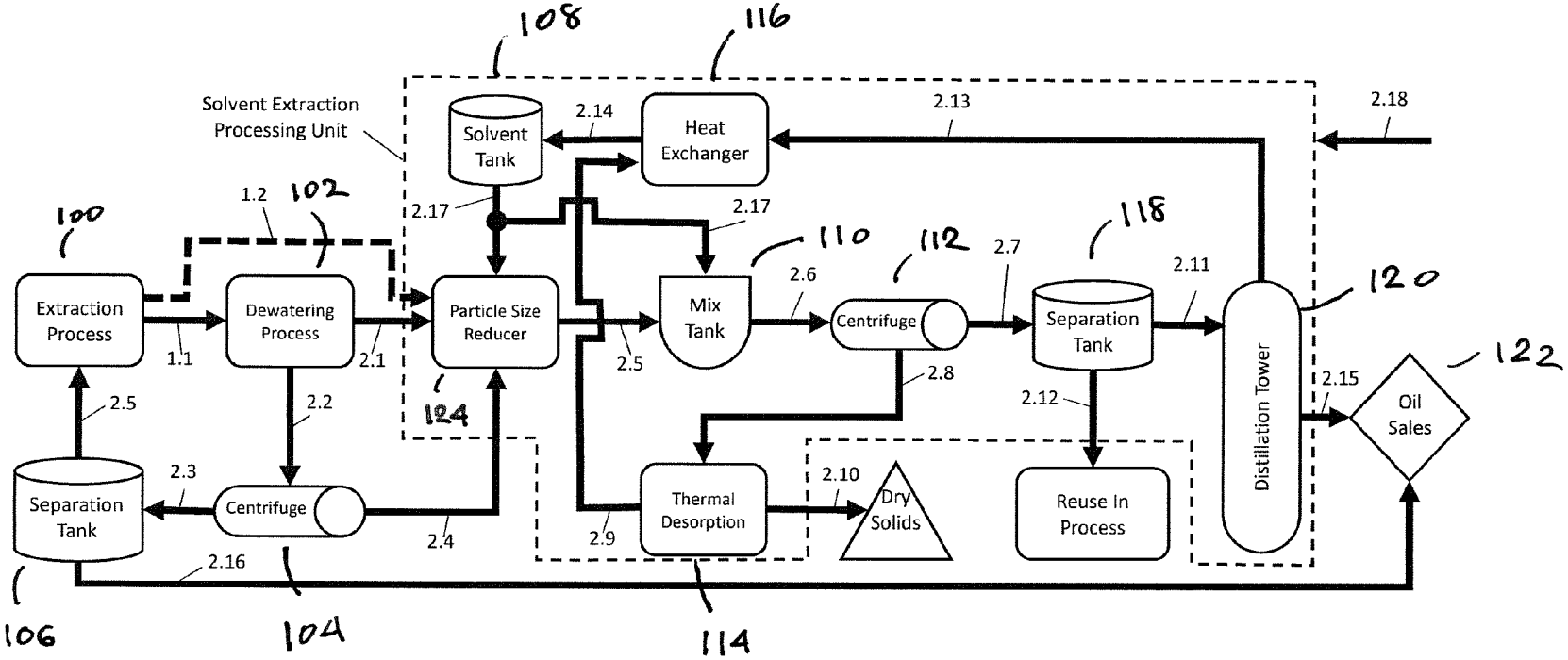
FIG. 1 is a schematic diagram of an embodiment of the surface separation process which may be utilized in the present invention.
Figure 2:
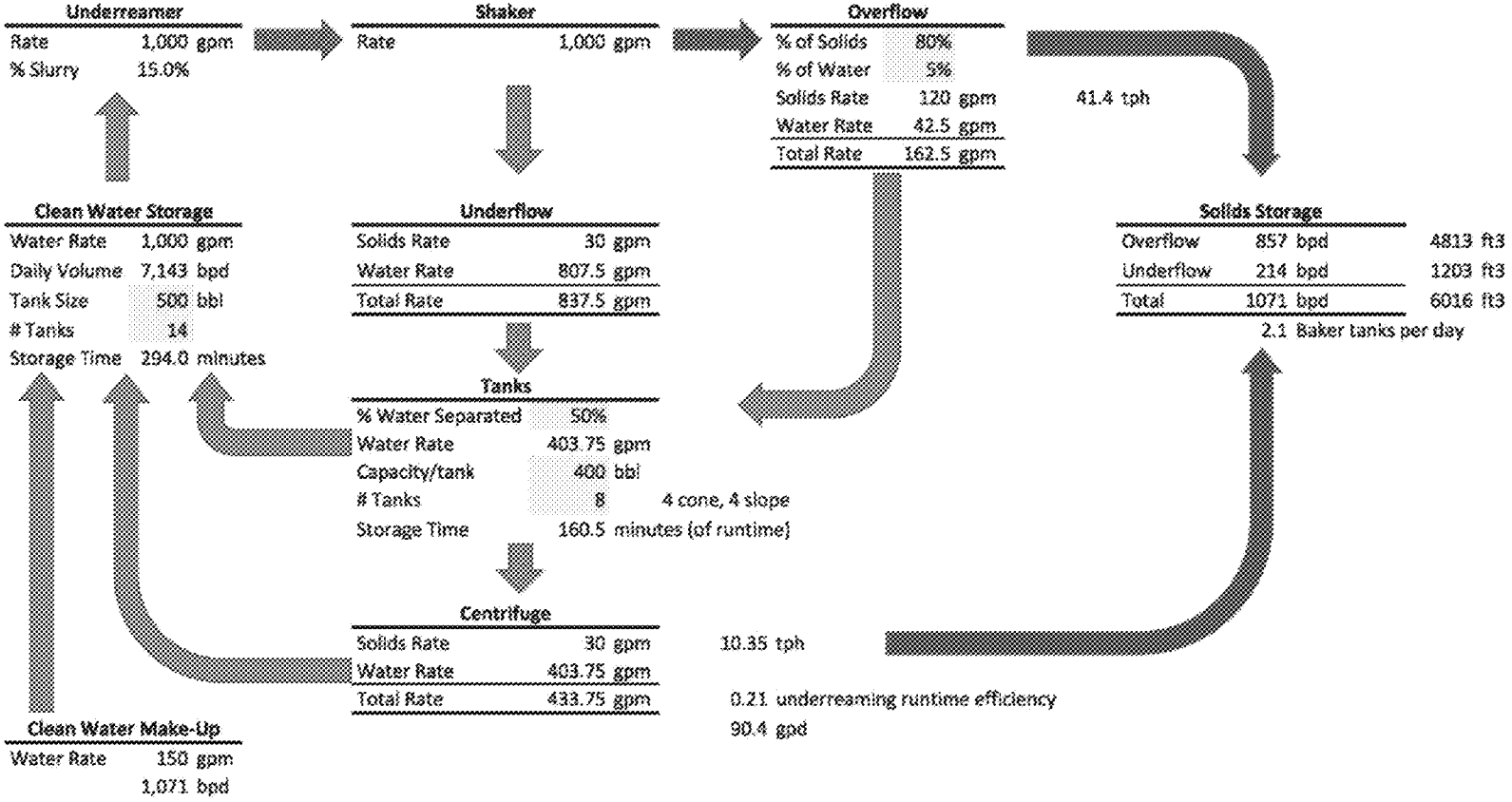
FIG. 2 provides an example of the surface separation process showing assumed values of incoming slurry, separated solids and liquids, and solids and liquids recovered for further processing and use.

FIG. 1 shows an embodiment of a process which may be used to separate oil from a material comprising diatomite. The term "material comprising diatomite" is herein after simplified to "diatomite," although it is understood that the solids which make up the matrix may include solid materials other than diatomite and contain liquids other than oil. The diatomite may be acquired, among other means such as surface mining, by an extraction process, such as a hydraulic borehole mining operation such as that described in U.S. Patent Application No. 2015/0107905.

In the event the extraction process 100 utilizes water to disaggregate the diatomite, the material is first dewatered to remove free water. For example, the process described in the '905 application utilizes water to recover the diatomite resulting in a slurry 1.1. A typical slurry 1.1 resulting from a hydraulic mining process may comprise 5-30% solids by volume. A typical device utilized in the dewatering process 102 may include a shale shaker, or series of shakers, which passes the slurry 1.1 over a screen allowing a large quantity of the solids to be captured, referred to as the "overflow" 2.1, and moved to the next processing stage. The overflow will typically capture eighty percent or more of the diatomite solids.

The fluids from the slurry 2.2, referred to as the "underflow", pass through a screen of the dewatering process 102 and are processed for recovery of any oil and water is processed for either reuse in the extraction process or for disposal or reclamation. The underflow will typically capture ninety percent or more of the liquid phase of the slurry 2.2. In the event that a significant quantity of diatomite fines are carried in the underflow 2.2 from the dewatering process 102, a solids removal process 104, such as a centrifuge, may be used to separate out and remove the fines from the fluid stream prior to reuse. The clean fluid stream 2.3 from the solids removal process 104 will then be sent to a separation tank 106 where the fluid 2.5 can be used to support the particular resource extraction process 100, such as a hydraulic borehole mining operation, or stored for other disposition. In the event that oil is entrained in the clean fluid stream 2.3 from the solids removal process 104, the separation tank 106 will allow the oil or any remaining solids 2.16 to first be separated.

The overflow 2.1 from the dewatering process 102 and the fines 2.4 recovered from the solids removal process 104 are sent to a particle size reducer 124 such as an attrition mill. In the event the extraction process 100 provides a dry material comprising diatomite, such as would be the case in a surface mining operatation, the dewatering process 102 may be omitted and the material 1.2 may be sent directly to the particle size reducer 124. In the event the diatomite is dehydrated, as could be the case if the material is weathered or exposed to atmospheric conditions for extended periods of time, the inventors herein have found that rehydrating the material prior to the solvent mixing stage described below is helpful. Rehydration of the diatomite has been found to improve the efficiency of the mixing process, reducing the volume of solvent required to recover oil from the material. Such a hydration step would normally occur after processing of the dry material through the particle size reducer 124. In hydrating the dry material, it has been found that a one-to-one volumetric ratio provides effective hydration of the dry material.

Depending on the size of the particles 2.1 in the overflow from the dewatering process 102 or particles 1.2 from a dry extraction process 100, a grinder may be used as part of or preliminary to the entry of the particles into the particular size reducer 124, such as an attrition mill. The dewatered diatomite streams 2.1, 2.4 or 1.2 are mixed with a solvent 2.17 from a solvent tank 108. The solvent 2.17 may be naphtha or another aromatic solvent which may be applied to the dewatered diatomite as it enters the particle size reducer 124 to thoroughly mix and shear the solvent and diatomite into a slurry 2.5. Other embodiments of the process may include particle sizing the diatomite prior to mixing with solvent 2.17. The inventors herein have determined that a volumetric ratio of solvent to diatomite of 2:1 is effective for certain heavy oil diatomaceous rock resources. It is anticipated that this ratio may be altered to accommodate other types of diatomite resources. For heavy oil applications, the inventors herein have found that aromatic solvents in particular result in improved recovery of oil from the diatomite.

The solvent/diatomite slurry 2.5 is sent to a mix tank 110 where the slurry will be thoroughly mixed, allowing sufficient time for the solvent to dissolve into the oil entrained in the diatomite. The material from the mix tank 110 may be recirculated through the particular size reducer 106, or another mix pump, if additional mixing or particle sizing is required. An acceptable particle size reduction for the diatomite is approximately No. 10 mesh (2 millimeters in diameter). The primary objective is to completely disaggregate the diatomite while limiting alteration of the individual diatom structures that comprise the rock thus improving surface area contact with the solvent and resulting in increased and accelerated recovery of oil from the diatomite. Additional solvent 2.17 may be added to the mix tank 110 if required.

Following sufficient mixing, particle size reduction, and retention time, the solvent/diatomite slurry 2.6 is sent to a centrifuge 112 for separation. One embodiment utilizes a two-phase centrifuge, but a three-phase centrifuge may also be used. Other embodiments may include the use of settling tanks to allow the diatomite solids to be separated using gravity. The diatomite solids 2.8 are removed using centrifugal and/or gravitational force and sent to a thermal desorption unit 114 to recover the residual portion of solvent remaining in the solids. The thermal desorption unit 114 heats the rock to evaporate any remaining solvent and then the remaining rock 2.10 is stored for disposal or to be used as backfill material for abandonment of any excavation from which the diatomite material was obtained.

The solvent vapor 2.9 from the thermal desorption unit 114 is sent to a heat exchanger 116 where condensed solvent 2.14 is returned to the solvent storage tank 108 where the solvent 2.17 is reused in the process. The solvent/oil/water fluid mixture 2.7 from the centrifuge 112 is sent to a separation tank 118 where any remaining water 2.12 can be separated for reuse in the process. The solvent/oil mixture 2.11 from the separation tank 118 is sent to a distillation process 120 to recover the solvent. The evaporated solvent 2.13 from the distillation process 120 is sent to heat exchanger 116 where condensed solvent 2.14 may be reused in the process. The oil 2.15 recovered from the distillation process 120 is sent to storage 122 to be sold.

An inert gas 2.18, such as nitrogen, is injected into those processing components utilizing solvent which are identified in FIG. 1 by the block entitled "Solvent Extraction Processing Unit" to maintain an inert gas blanket to prevent explosions.

The separation process as generally depicted in FIG. 1 is continued until the targeted resource is processed While the above is a description of various embodiments of the present invention, further modifications may be employed without departing from the spirit and scope of the present invention. Thus the scope of the invention should not be limited according to these factors, but according to the following append claims.

What is claimed is:

1. A method for recovery of hydrocarbons from a slurry obtained from an extraction process, the slurry comprising diatomite, the method comprising the steps of:

a) dewatering the slurry comprising diatomite using a shale shaker resulting in a water phase and a diatomite phase, the diatomite phase comprising diatomite solids having an average particle size greater than a first size;

b) sending the water phase back to the extraction process for use in producing additional slurry comprising diatomite;

c) mixing the diatomite phase with a solvent to form a solvent-diatomite slurry;

d) reducing the average particle size of the diatomite solids from the first size to an average particle size to a second particle size to create a homogenous slurry comprising solvent and diatomite solids having an average particle size smaller than the first size;

e) separating the diatomite solids from the homogenous slurry resulting in a liquid phase comprising a mixture of liquid hydrocarbons and liquid solvent and a solid phase comprising diatomite solids; and f) recovering any residual solvent from the diatomite solids by a thermal desorption process; and g) recovering solvent from the liquid phase by a distillation process.

2. The method of claim 1 wherein the extraction process comprises hydraulic borehole mining.

3. The method of claim 1 wherein the solvent comprises an aromatic solvent.

4. The method of claim 3 wherein the solvent comprises naphtha.

5. The method of claim 1 wherein the average particle size is reduced by an attrition mill.

6. The method of claim 1 wherein the volumetric ratio of solvent to diatomite phase is approximately 2 parts solvent to one part diatomite phase.

7. The method of claim 1 wherein the slurry comprising diatomite comprises 5-30% solids by volume.

8. The method of claim 1 wherein the diatomite solids are separated from the homogenous slurry by a centrifuge.

9. The method of claim 8 wherein the diatomite solids separated from the homogenous slurry are utilized as backfill material to fill an excavation resulting from the extraction process.

10. A method of recovery of hydrocarbons from a diatomite reservoir obtained by a hydraulic borehole mining process which produces a slurry comprising diatomite solids and a liquid phase comprising water and hydrocarbons, the method comprising the steps of:

directing the slurry through a shale shaker resulting in an overflow stream comprising at least eighty percent of the diatomite solids and an underflow stream comprising at least ninety percent of the liquid phase;

separating at least a portion of any solids remaining from the liquid phase resulting in a clean water phase;

reusing the clean water phase in the hydraulic borehole mining process;

mixing the overflow stream with a solvent to form a solvent-diatomite slurry;

separating any diatomite solids from the solvent-diatomite slurry leaving a liquid phase comprising liquid hydrocarbons and liquid solvent;

recovering residual solvent from the diatomite solids by a thermal desorption process leaving a portion of cleaned diatomite solids; and recovering solvent from the liquid phase by a extraction process.

11. The method of claim 10 wherein the solvent comprises an aromatic solvent.

12. The method of claim 11 wherein the solvent comprises naphtha.

13. The method of claim 10 including the further step of directing the overflow stream to an attrition mill for reducing the size of the diatomite solids.

14. The method of claim 10 wherein the volumetric ratio of solvent to the overflow stream is approximately one part solvent to one party overflow stream.

15. The method of claim 10 including the further step of utilizing the portion of cleaned diatomite solids as a backfill material for an excavation resulting from the hydraulic borehole mining process.

* * * * *